US011331766B2

(12) United States Patent
Nakanishi et al.

(10) Patent No.: US 11,331,766 B2
(45) Date of Patent: May 17, 2022

(54) SUBSTRATE POLISHING DEVICE AND POLISHING METHOD

(71) Applicant: EBARA CORPORATION, Tokyo (JP)

(72) Inventors: Masayuki Nakanishi, Tokyo (JP); Kenji Kodera, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 863 days.

(21) Appl. No.: 16/182,444

(22) Filed: Nov. 6, 2018

(65) Prior Publication Data

US 2019/0134776 A1 May 9, 2019

(30) Foreign Application Priority Data

Nov. 7, 2017 (JP) ..... JP2017-214570

(51) Int. Cl.
*B24B 37/10* (2012.01)
*B24B 41/06* (2012.01)
(Continued)

(52) U.S. Cl.
CPC ..... *B24B 37/10* (2013.01); *B24B 27/0015* (2013.01); *B24B 37/005* (2013.01);
(Continued)

(58) Field of Classification Search
CPC ..... B24B 37/00; B24B 37/005; B24B 37/04; B24B 37/042; B24B 37/10; B24B 37/105;
(Continued)

(56) References Cited

U.S. PATENT DOCUMENTS 6,152,805 A * 11/2000 Takahashi ..... B24B 31/116 451/104
6,390,903 B1 * 5/2002 Takahashi ..... B24B 37/105 451/286
(Continued)

FOREIGN PATENT DOCUMENTS

EP 1193032 A2 4/2002
EP 1408538 A1 4/2004
(Continued)

OTHER PUBLICATIONS

European Patent Application No. 18204957.7; Extended Search Report; dated Apr. 5, 2019; 10 pages.

*Primary Examiner* — Joel D Crandall
(74) *Attorney, Agent, or Firm* — BakerHostetler

(57) ABSTRACT

One object is to improve the uniformity of polishing of a substrate.
The present application discloses, as one embodiment, a substrate polishing device for a quadrilateral-shaped substrate, the device including: a surface plate; a substrate support mechanism that is attached to the surface plate and that supports the substrate; a polishing head mechanism for attaching a polishing pad, the polishing head mechanism opposing the surface plate; and an orbital drive mechanism for orbitally driving the polishing head mechanism. The substrate support mechanism includes: a base plate; a plate flow passage provided to the base plate; and a plurality of substrate support chambers that are connected to the plate flow passage, wherein each substrate support chamber independently applies a vertical direction force to the substrate, and the vertical direction force applied to the substrate corresponds to an internal pressure of the substrate support chamber.

9 Claims, 7 Drawing Sheets

(51) Int. Cl.

| | |
|---|---|
| ***B24B 41/047*** | (2006.01) |
| ***B24B 37/12*** | (2012.01) |
| ***B24B 27/00*** | (2006.01) |
| ***B24B 37/30*** | (2012.01) |
| ***B24B 37/005*** | (2012.01) |
| ***B24B 37/04*** | (2012.01) |

(52) U.S. Cl.
CPC ..... *B24B 37/042* (2013.01); *B24B 37/12* (2013.01); *B24B 37/30* (2013.01); *B24B 41/047* (2013.01); *B24B 41/068* (2013.01)

(58) Field of Classification Search
CPC ..... B24B 37/107; B24B 37/11; B24B 37/12; B24B 37/16; B24B 37/20; B24B 37/26; B24B 37/27; B24B 37/30; B24B 37/32; B24B 49/16; B24B 41/047
See application file for complete search history.

(56) References Cited

U.S. PATENT DOCUMENTS

2003/0186624 A1* 10/2003 Koike ..... B24B 37/30 451/8
2004/0224615 A1* 11/2004 Chen ..... B24B 37/16 451/41
2007/0060027 A1 3/2007 Kobayashi et al.
2008/0085658 A1 4/2008 Katsuoka et al.
2011/0195640 A1* 8/2011 Cellier ..... B24B 37/245 451/56
2014/0162534 A1* 6/2014 Lin ..... H01L 21/673 451/41
2015/0273649 A1 10/2015 Kosuge et al.
2016/0016280 A1* 1/2016 Chen ..... B24B 37/10 438/692

FOREIGN PATENT DOCUMENTS

| | | | | | |
|---|---|---|---|---|---|
| JP | H10-329011 | A | | 12/1998 | |
| JP | 2003-048149 | A | | 2/2003 | |
| JP | 2003048148 | A | * | 2/2003 | ..... B24B 37/042 |
| JP | 2005-271111 | A | | 10/2005 | |
| JP | 2008-110471 | A | | 5/2008 | |
| JP | 2010-064196 | A | | 3/2010 | |
| JP | 2010-099763 | A | | 5/2010 | |
| JP | 2015-188955 | A | | 11/2015 | |
| TW | 200518256 | A | | 6/2005 | |

* cited by examiner

SUBSTRATE POLISHING DEVICE AND POLISHING METHOD

CROSS-REFERENCE TO RELATED APPLICATION

This application is based upon and claims benefit of priority from Japanese Patent Application Nos. 2017-214570 filed on Nov. 7, 2017, the entire contents of which is incorporated herein by reference.

TECHNICAL FIELD

The present invention relates to a substrate polishing device and a polishing method.

BACKGROUND ART

In the course of manufacturing a semiconductor device, a Chemical Mechanical Polishing (CMP) device is used to planarize the surface of a substrate. Substrates for use in the manufacture of a semiconductor device were often in the shape of a disk. However, recently there are cases in which quadrilateral-shaped substrates are used. Examples of a quadrilateral-shaped substrate include normal silicon substrates as well as various other substrates, such as CCL substrates (Copper Clad Laminate substrates), PCB (Printed Circuit Board) substrates, and photomask substrates. Therefore, the demand for planarizing quadrilateral-shaped substrates is increasing.

CITATION LIST

Patent Literature

PTL 1: JP2003-48149A
PTL 2: JP2008-110471A
PTL 3: JP2005-271111A

SUMMARY OF INVENTION

Technical Problem

Currently, a "rotary-type" CMP device, which polishes a substrate while rotating both a polishing table and the substrate, is widely used. However, when using a rotary-type CMP device to polish a quadrilateral-shaped substrate, the corner parts and/or edge parts of the substrate may be overpolished due to a concentration of the load at the corner parts and/or edge parts of the substrate. Further, when using a rotary-type CMP device to polish a quadrilateral-shaped substrate, the polishing may be insufficient at the center portion of the substrate. In particular, if the quadrilateral-shaped substrate is large, the amount of polishing may become considerably different between the corner parts and/or edge parts of the substrate and the center part of the substrate. Thus, one object of the present invention is to improve the uniformity of polishing in a substrate polishing device for polishing a quadrilateral-shaped substrate.

Solution To Problem

The present application discloses, as one embodiment of the present invention, a substrate polishing device for polishing a quadrilateral-shaped substrate, the substrate polishing device including: a surface plate; a substrate support mechanism that is attached to the surface plate and that supports the substrate; a polishing head mechanism for attaching a polishing pad, the polishing head mechanism opposing the surface plate; and an orbital drive mechanism for orbitally driving the polishing head mechanism. The substrate support mechanism includes: a base plate; a plate flow passage provided to the base plate; and a plurality of substrate support chambers that are connected to the plate flow passage, wherein each substrate support chamber independently applies a vertical direction force to the substrate, and the vertical direction force applied to the substrate corresponds to an internal pressure of the substrate support chamber. The present application further discloses, as one embodiment of the present invention, a substrate polishing device wherein each substrate support chamber applies to the substrate a vertical direction force corresponding to the internal pressure.

Unlike a "rotary-type" CMP device that polishes the substrate while rotating both the polishing table and the substrate, the above-described substrate polishing device polishes the substrate without rotating the substrate, and thus it is conceivable that concentration of the load at the corner parts and/or edge parts of the substrate does not easily occur. Further, this substrate polishing device can locally control a pressing force between the substrate and the polishing pad. Therefore, the substrate device achieves, as one example, an effect of being able to improve the uniformity of polishing of a quadrilateral-shaped substrate.

The present application further discloses, as one embodiment of the present invention, a substrate polishing device wherein at least one of the plurality of substrate support chambers is defined by a recess formed in the base plate.

This substrate polishing device achieves, as one example, an effect in which the surface to which the substrate is attached can easily be made into a flat surface.

The present application further discloses, as one embodiment of the present invention, a substrate polishing device wherein at least one of the plurality of substrate support chambers is formed by an elastic pad attached to the base plate, the elastic pad attached to the base plate being stretchable at least in the vertical direction.

This substrate polishing device achieves, as one example, an effect in which leaks of a fluid from the substrate support chambers can be suppressed.

The present application further discloses, as one embodiment of the present invention, a substrate polishing device wherein the plurality of substrate support chambers are disposed so as to independently apply a vertical direction force to corner parts and/or edge parts of the substrate and to a portion other than the corner parts and/or the edge parts of the substrate.

This substrate polishing device achieves, as one example, an effect in which insufficient polishing in the center portion of the substrate can be eliminated.

The present application further discloses, as one embodiment of the present invention, a substrate polishing device wherein the overall outer shape of the plurality of substrate support chambers is a quadrilateral shape similar to the substrate.

This substrate polishing device achieves, as one example, an effect in which the substrate support chambers can be easily disposed along the corner parts and/or edge parts of the substrate.

The present application further discloses, as one embodiment of the present invention, a substrate polishing device wherein the polishing head mechanism includes: a polishing head main body; a head flow passage provided to the polishing head main body; and a plurality of polishing pad support chambers that are connected to the head flow passage, wherein each polishing pad support chamber independently applies a vertical direction force to the polishing pad, and the vertical direction force applied to the polishing pad corresponds to an internal pressure of the polishing pad support chamber.

This substrate polishing device achieves, as one example, an effect in which the range of controllable pressing force can be expanded.

The present application further discloses, as one embodiment of the present invention, a substrate polishing device wherein the polishing head mechanism and the orbital drive mechanism are configured such that all points on a surface to be polished of the substrate are constantly in contact with the polishing pad while the polishing head mechanism is being orbitally driven.

This substrate polishing device achieves, as one example, an effect in which the polishing time can be made uniform at all points on the surface to be polished of the substrate.

The present application further discloses, as one embodiment of the present invention, a substrate polishing device including a pressure control mechanism that is connected to the plate flow passage.

This substrate polishing device achieves, as one example, an effect in which the internal pressure of the substrate support chambers can be controlled.

The present application further discloses, as one embodiment of the present invention, a substrate polishing device for polishing a quadrilateral-shaped substrate, the substrate polishing device including: a surface plate for directly or indirectly supporting the substrate; a polishing head mechanism for attaching a polishing pad, the polishing head mechanism opposing the surface plate; and an orbital drive mechanism for orbitally driving the polishing head mechanism. The polishing head mechanism includes: a polishing head main body; a head flow passage provided to the polishing head main body; and a plurality of polishing pad support chambers that are connected to the head flow passage, wherein each polishing pad support chamber independently applies a vertical direction force to the polishing pad, and the vertical direction force applied to the polishing pad corresponds to an internal pressure of the polishing pad support chamber.

This substrate polishing device achieves, as one example, an effect in which the pressing force can be locally controlled without providing a chamber to the substrate support mechanism. However, this does not exclude further providing a chamber to the substrate support mechanism in the above configuration.

The present application further discloses, as one embodiment of the present invention, a substrate polishing device wherein the plurality of polishing pad support chambers are formed by an elastic pad attached to the polishing head main body, the elastic pad attached to the polishing head main body being stretchable at least in the vertical direction.

This disclosure explains the polishing pad support chambers in detail.

The present application further discloses, as one embodiment of the present invention, a substrate polishing device for polishing a quadrilateral-shaped substrate, the substrate polishing device including: a surface plate for directly or indirectly supporting the substrate; a polishing head mechanism for attaching a polishing pad, the polishing head mechanism opposing the surface plate; an orbital drive mechanism for orbitally driving the polishing head mechanism; a head vertical movement mechanism for vertically moving the polishing head mechanism; and a control part, wherein the control part controls the orbital drive mechanism to orbitally drive the polishing head mechanism, and the control part controls the head vertical movement mechanism to increase/decrease a pressing force between the substrate and the polishing pad while the polishing head mechanism is being orbitally driven. The present application further discloses, as one embodiment of the present invention, a quadrilateral-shaped substrate polishing method wherein a substrate is retained, a polishing of the substrate is performed by slidingly contacting a polishing pad provided to a polishing head to the retained substrate, and by orbitally driving the polishing head, wherein during the polishing of the substrate, a pressing force of the polishing pad on the substrate is adjusted by a head vertical movement mechanism for vertically moving the polishing head.

This substrate polishing device and polishing method achieve, as one example, an effect in which a desired polishing rate can be achieved in each region of the substrate.

DESCRIPTION OF EMBODIMENTS

First Embodiment

Figure 1A:
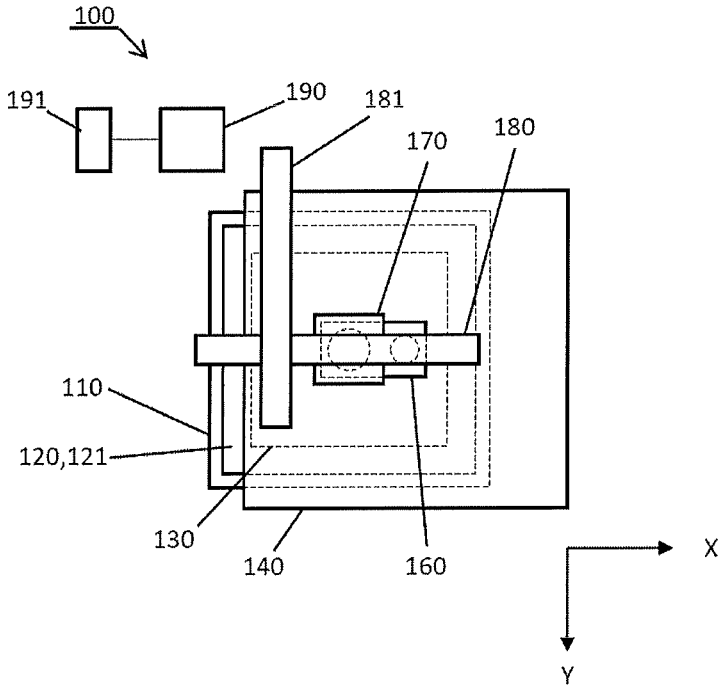
FIG. 1A is a top surface view of a substrate polishing device.
Figure 1B:
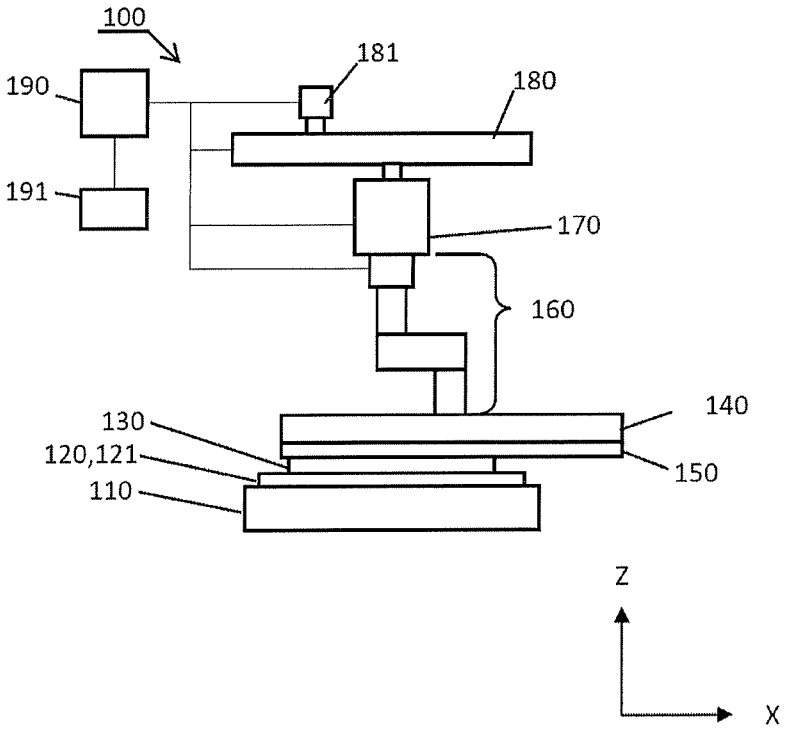
FIG. 1B is a front surface view of the substrate polishing device.

FIG. 1 schematically illustrates a substrate polishing device 100 according to a first embodiment. FIG. 1A is a top surface view of the substrate polishing device 100. FIG. 1B is a front surface view of the substrate polishing device 100. In the following, the left-right direction in FIG. 1A will be referred to as the X direction, the up-down direction in FIG. 1A will be referred to as the Y direction, and the up-down direction in FIG. 1B will be referred to as the Z direction (vertical direction).

The substrate polishing device 100 is a device for polishing a quadrilateral-shaped substrate 130. The substrate polishing device 100 includes a surface plate 110, and a substrate support mechanism 120 that is attached to the surface plate 110 and that supports the substrate 130. In the example of FIG. 1, a base plate 121 is provided as the substrate supporting mechanism 120. The base plate 121 is mounted on the top surface of the surface plate 110. As long as the substrate 130 can be polished, any method may be used to support the substrate 130. Similarly, as long as the substrate 130 can be polished, any method may be used to attach the base plate 121.

The substrate polishing device 100 further includes a polishing head mechanism 140 that is disposed opposing the surface plate 110. The polishing head mechanism 140 may also be referred to as a "polishing head". The polishing head mechanism 140 is provided for attaching a polishing pad 150. During polishing of the substrate 130, the polishing pad 150 slidingly contacts the substrate 130. The substrate polishing device 100 further includes an orbital drive mechanism 160 for orbitally driving the polishing head mechanism 140. The substrate polishing device 100 further includes a head vertical movement mechanism 170 for raising and lowering the polishing head mechanism 140.

The substrate polishing device 100 preferably includes a mechanism for moving the polishing head mechanism 140 in parallel within the X-Y plane. In the example of FIG. 1, an X-direction linear actuator 180 that drives the polishing head mechanism 140 in the X direction and a Y-direction linear actuator 181 that drives the polishing head mechanism 140 in the Y direction are provided. By configuring the polishing head mechanism 140 so as to be capable of parallel movement, a center position of orbital driving (to be explained later) can be adjusted. Further, by configuring the polishing head mechanism 140 so as to be capable of parallel movement, the polishing head mechanism 140 can be easily retreated to a predetermined position, e.g. a position for dressing the polishing pad 150, during maintenance of the device.

In addition, the substrate polishing device 100 may include a control part 190 for controlling the various constituent mechanisms. Further, the substrate polishing device 100 may include a storage part 191 for storing various control conditions. For convenience of illustration, control lines connecting the control part 190 to the other elements (excluding the storage part 191) have been omitted from FIG. 1A.

The base plate 121 of the example in FIG. 1 is formed to have a quadrilateral shape larger than the substrate 130 when viewed from above. In other words, the base plate 121 is formed such that the base plate 121 can completely cover the substrate 130 when viewed from below. Further, the surface plate 110 of the example in FIG. 1 is formed to have a quadrilateral shape larger than the base plate 121 when viewed from above. In other words, the surface plate 110 is formed such that the surface plate 110 can completely cover the base plate 121 when viewed from below. However, the size and shape of the surface plate 110 and the base plate 121 are not limited to those illustrated. For example, the size of the base plate 121 when viewed from above may be smaller than the substrate 130. The surface plate 110 and the base plate 121 may be formed in a shape other than a quadrilateral shape, such as a circular shape when viewed from above.

In the example of FIG. 1, the surface plate 110 indirectly supports the substrate 130 via the base plate 121. Therefore, even if the size and/or shape of the substrate 130 to be polished is changed, a new substrate 130 can be supported by exchanging only the base plate 121. Further, by using the base plate 121, the possibility that the polishing pad 150 will contact the surface plate 110 can be reduced. As a structure different from that of the example in FIG. 1, a structure in which the surface plate 110 directly supports the substrate 130 may be adopted. In a structure in which the surface plate 110 directly supports the substrate 130, the base plate 121 is not used, and thus the number of parts to be used can be reduced. Reducing the number of parts can reduce assembly errors and/or manufacturing costs.

The polishing head mechanism 140 is disposed above the surface plate 110. More specifically, the polishing head mechanism 140 is disposed so that the bottom surface of the polishing head mechanism 140, i.e. the surface to which the polishing pad 150 is adhered, opposes the surface plate 110. Similar to the shape of the substrate 130, the bottom surface of the polishing head mechanism 140 is preferably configured in a quadrilateral shape when viewed from above. Also, similar to the shape of the substrate 130, the polishing pad 150 is preferably configured in a quadrilateral shape when viewed from above. However, the polishing head mechanism 140 and the polishing pad 150 may be configured in a shape other than a quadrilateral shape, such as a circular shape when viewed from above. Further, the polishing head mechanism 140 may include a polishing head main body 220 and a fluid supply line 221 (refer to FIG. 2).

The polishing head mechanism 140 is connected to the orbital drive mechanism 160 at a center portion of the top surface of the polishing head mechanism 140. The orbital drive mechanism 160 drives the polishing head mechanism 140 such that a trajectory in the X-Y plane of the polishing head mechanism 140 becomes a circle. If, for example, the device as a whole is disposed so as to be tilted from horizontal, the X-axis and/or the Y-axis will also be tilted. The orbital drive mechanism 160 is configured to restrict the rotation of the polishing head mechanism 140 around the connection position of the orbital drive mechanism 160 and the polishing head mechanism 140, i.e. to restrict the polishing head mechanism 140 from rotating around its own axis. In the following, movement of the polishing head mechanism 140 such that its trajectory becomes a circle in the X-Y plane and the polishing head mechanism 140 does not rotate around its own axis will be referred to as "orbital movement (of the polishing head mechanism 140)".

The polishing head mechanism 140 is connected to the head vertical movement mechanism 170 for raising and lowering the polishing head mechanism 140. In the example of FIG. 1, the head vertical movement mechanism 170 is connected to the polishing head mechanism 140 via the orbital drive mechanism 160. However, the structure of the head vertical movement mechanism 170 is not limited to the structure shown in FIG. 1.

The control part 190 can control the head vertical movement mechanism 170 so as to make the substrate 130 and the polishing pad 150 contact each other and to release the contact between the substrate 130 and the polishing pad 150. Further, the control part 190 can control the head vertical movement mechanism 170 while maintaining the state in which the substrate 130 and the polishing pad 150 are contacting each other so as to increase/decrease the pressing force between the substrate 130 and the polishing pad 150. Thereby, the polishing rate of the substrate can be set to a desired polishing rate.

By controlling the pressing force between the substrate 130 and the polishing pad 150 while the polishing head mechanism 140 is being orbitally driven, the polishing rate can be controlled according to the position of the polishing head mechanism 140. For example, if the polishing rate at a certain instant changes compared to the polishing rate at another instant due to a manufacturing error or the like, control can be performed to increase/decrease the pressing force at that instant so as to compensate for the change in the polishing rate. For example, in FIG. 1, if the polishing rate decreases only when the polishing head mechanism 140 is positioned at the rightmost side (the case shown in FIG. 1A), the substrate polishing device 100 can be controlled so as to increase the pressing force while the polishing head mechanism 140 is positioned at the rightmost side. Further, if the size of the polishing head mechanism 140 is smaller than the size of the substrate 130, control can be performed to increase/decrease the pressing force when the polishing pad 150 is contacting a specific point on the substrate 130 and to decrease/increase the pressing force when the polishing pad 150 is not contacting the specific point.

In order to control pressing force, the head vertical movement mechanism 170 may be controlled according to control conditions that are pre-stored in the storage part 191. During or after polishing of the substrate 130, the overall or local polishing rate (or polishing amount) of the substrate 130 can be measured by a measurement instrument (not illustrated) and the measurement result of the polishing rate can be fed back so as to compensate for fluctuations in the polishing rate. Further, the head vertical movement mechanism 170 may be controlled according to conditions input by a user using an input part (not illustrated).

If the orbital drive radius of the polishing head mechanism 140 is large, the polishing head mechanism 140 may protrude out considerably from the substrate 130. If the protrusion amount is large, the polishing head mechanism 140 may tilt when the polishing pad 150 is pressed to the substrate 130, thereby causing the load to concentrate at the corner parts and/or edge parts of the substrate 130. In order to prevent a concentration of the load due to tilting of the polishing head mechanism 140, the parts of the substrate polishing device 100 such as the polishing head mechanism 140 and the orbital drive mechanism 160 are preferably made of rigid bodies so as to reduce the flexure of the parts and rattling between the parts. On the other hand, tilting of the polishing head mechanism 140 can also be prevented by providing the polishing head mechanism 140 with a gimbal mechanism (not illustrated) and a load control structure (not illustrated) such as a spring or actuator.

Tilting of the polishing head mechanism 140 can be prevented by reducing the orbital drive radius so as to reduce the protrusion amount of the polishing head mechanism 140. However, if the orbital drive radius is drastically reduced, it may become difficult to increase the orbital drive speed of the polishing head mechanism 140. Further, if the orbital drive radius is drastically reduced, the uniformity of polishing of the substrate 130 may decrease due to local unevenness of the polishing pad 150, etc. The orbital drive radius is preferably determined in consideration of various conditions, such as the tilting of the polishing head mechanism 140, the drive speed of the polishing head mechanism 140, and the desired uniformity, etc. as mentioned above.

Figure 2:
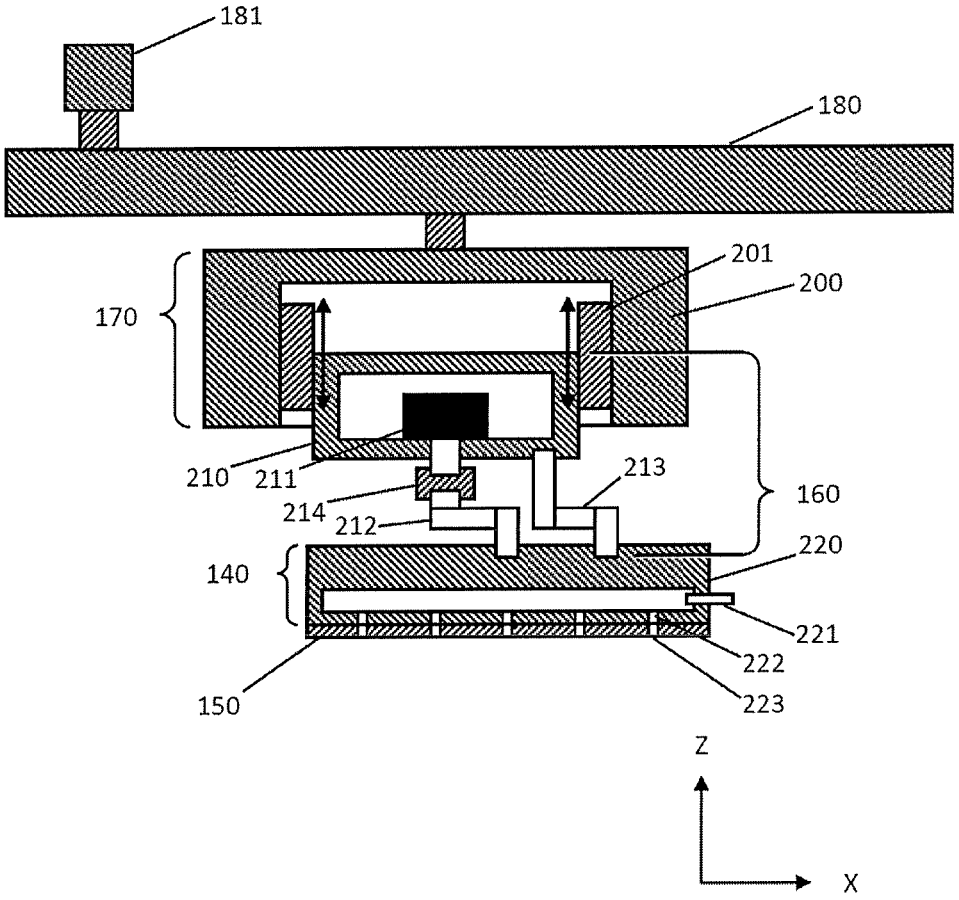
FIG. 2 is a front surface cross-section view of a polishing head mechanism and an orbital drive mechanism, etc.

The polishing head mechanism 140 and the orbital drive mechanism 160 will now be explained in detail using FIG. 2. FIG. 2 is a front surface cross-section view of the polishing head mechanism 140 and the orbital drive mechanism 160, etc. As is also shown in FIG. 1, the orbital drive mechanism 160 is connected to the head vertical movement mechanism 170. The head vertical movement mechanism 170 includes a housing 200 and a linear actuator 201 retained within the housing 200. The linear actuator 201 can vertically move the orbital drive mechanism 160. Instead of the linear actuator 201, an air cylinder or a motor, etc. may be used.

The orbital drive mechanism 160 includes a motor box 210, a motor 211, a main crank 212, and an auxiliary crank 213. The motor box 210 is connected to the linear actuator 201. The motor 211 is provided to the inside of the motor box 210. One end of the main crank 212 is connected to a shaft of the motor 211 via a joint 214. The other end of the main crank 212 is connected to the center of the top surface of the polishing head mechanism 140 (more specifically, of the polishing head main body 220 to be explained below). The main crank 212 is not prevented from rotating (is not "detented", is not whirl-stopped, or a rotation stopper is not attached) at the site of connection between the main crank 212 and the polishing head mechanism 140. In other words, the main crank 212 is configured to be capable of idling (wheel slipping). The connection between the main crank 212 and the polishing head mechanism 140 may be achieved by fitting (especially by clearance fitting), or the connection may be achieved using a bearing or the like.

One end of the auxiliary crank 213 is connected to the bottom surface of the motor box 210. The auxiliary crank 213 is not prevented from rotating at the site of connection between the auxiliary crank 213 and the motor box 210. The other end of the auxiliary crank 213 is connected to the top surface of the polishing head mechanism 140 (more specifically, of the polishing head main body 220 to be explained below) so as not to interfere with the main crank 212. Further, the auxiliary crank 213 is not prevented from rotating at the site of connection between the auxiliary crank 213 and the polishing head mechanism 140. The crank radius of the auxiliary crank 213 is configured to be equal to the crank radius of the main crank 212. In FIG. 2, only one auxiliary crank 213 is shown, but multiple auxiliary cranks may be provided.

The control part 190 (not illustrated in FIG. 2) is configured to be capable of controlling the linear actuator 201 and the motor 211.

In the configuration of FIG. 2, when the motor 211 is driven by the control of the control part 190, the motive power of the motor 211 is transmitted to the polishing head mechanism 140 via the main crank 212. As a result, the polishing head mechanism 140 is driven such that the trajectory in the X-Y plane of the polishing head mechanism 140 becomes a circle (in other words, the polishing head mechanism 140 is driven so that the polishing head mechanism 140 revolves). Further, rotation of the polishing head mechanism 140 around its own axis is restricted because the main crank 212 is not prevented from rotating and because the auxiliary crank 213 exists. Therefore, the polishing head mechanism 140 is orbitally driven by the motor 211.

The polishing head mechanism 140 may be at least partially configured by the polishing head main body 220 and the fluid supply line 221. The fluid supply line 221 is a pipe for supplying a fluid, such as air, a polishing liquid, a chemical liquid, and/or a washing water, etc., to the inside of the polishing head main body 220. The fluid that is supplied is discharged toward the polishing pad 150 (i.e. toward the surface to be polished of the substrate 130) from a through hole 222 provided to the bottom surface of the polishing head main body 220. Further, a through hole 223 corresponding to the through hole 222 is preferably provided to the polishing pad 150.

Figure 3:
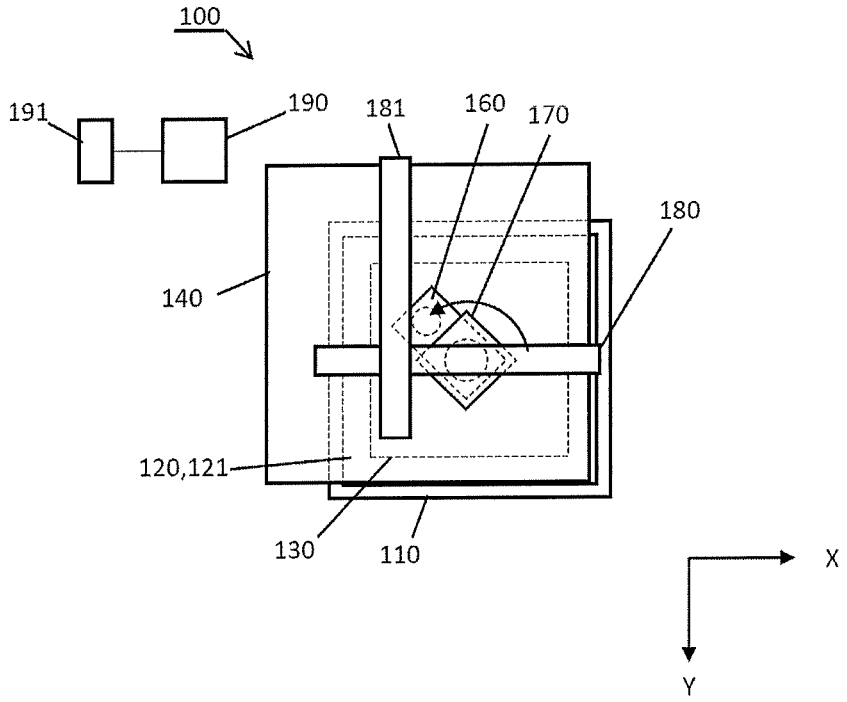
FIG. 3 is a top surface view of the substrate polishing device, illustrating the orbital driving of the polishing head mechanism.

The orbital driving of the polishing head mechanism 140 (polishing head main body 220) by the orbital drive mechanism 160 will now be explained using FIG. 3. FIG. 3 is a top surface view illustrating the substrate polishing device 100 in a state in which the orbital driving of the polishing head mechanism 140 has progressed by ⅜ of a revolution in the counter clockwise direction from FIG. 1A. The trajectory of the orbital driving from FIG. 1A to FIG. 3 is indicated by a solid line arrow in FIG. 3. Since the polishing head mechanism 140 is prevented from rotating around its own axis, the orientation of the polishing head mechanism 140 is kept constant while the polishing head mechanism 140 is being orbitally driven. According to the configuration explained above, the circumferential speed between the substrate 130 and the polishing head mechanism 140 at a certain instant is the same at all portions on the substrate 130. Therefore, the substrate polishing device 100 according to the present embodiment can improve the uniformity of polishing of the substrate 130.

The polishing head mechanism 140 and the orbital drive mechanism 160 are preferably configured so that all points on the surface to be polished of the substrate 130 are constantly in contact with the polishing pad 150 while the polishing head mechanism 140 is being orbitally driven. By configuring the device such that all points on the top surface of the substrate 130 are constantly in contact with the polishing pad 150, the polishing time can be made uniform at all points on the substrate 130.

The polishing head mechanism 140 and the orbital drive mechanism 160 may be configured so that there is point(s) on the surface to be polished of the substrate 130 that is temporarily not in contact with the polishing pad 150. Similarly, the polishing head mechanism 140 and the orbital drive mechanism 160 may be configured so that there is point(s) on the surface to be polished of the substrate 130 that is constantly not in contact with the polishing pad 150. As an example, mention may be made of a case in which the size of the polishing head mechanism 140 is smaller than the size of the substrate 130 to be polished. If there is point(s) on the surface to be polished of the substrate 130 that are temporarily or constantly not in contact with the polishing pad 150, this means that the polishing time will be different depending on the position on the substrate 130. By configuring the device such that there is point(s) on the surface to be polished of the substrate 130 that is temporarily or constantly not in contact with the polishing pad 150, the polishing time can be increased at a specific position (for example, a position where the polishing is insufficient, etc.) on the substrate 130 and the polishing time can be decreased at the other positions.

In the substrate polishing device 100 according to the present embodiment, the substrate 130 itself does not rotate. Therefore, unlike in a rotary-type CMP device, it is conceivable that in the substrate polishing device 100 according to the present embodiment, concentration of the load at the corner parts and/or edge parts of the quadrilateral-shaped substrate 130 does not easily occur. Thus, the substrate polishing device 100 according to the present embodiment can further improve the uniformity of polishing of the quadrilateral-shaped substrate 130. Further, unlike in a rotary-type CMP device, it is not necessary to provide a large turn table in the present embodiment. Therefore, the footprint of the substrate polishing device 100 according to the present embodiment can be made smaller than the footprint of a rotary-type CMP device.

Figure 4:
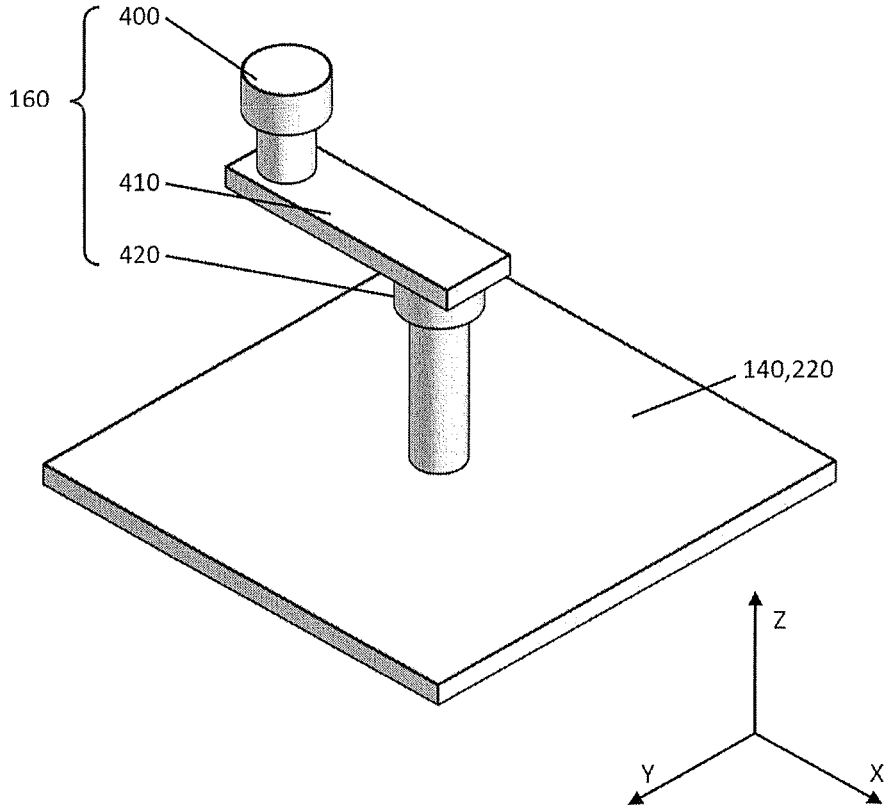
FIG. 4 is a perspective view illustrating another example of the orbital drive mechanism.

It is also possible to use an orbital drive mechanism 160 of a configuration other than that shown in FIG. 2. FIG. 4 is a perspective view illustrating another example of the orbital drive mechanism 160. This orbital drive mechanism 160 includes a main motor 400. The main motor 400 is controlled by the control part 190. The shaft of the main motor 400 is provided parallel to the Z axis. An arm 410 that extends parallel to the X-Y plane is connected to the shaft of the main motor 400. An auxiliary motor 420 is provided to the other end of the arm 410. The auxiliary motor 420 is configured so as to be capable of rotating the polishing head mechanism 140 (the polishing head main body 220). The shaft of the auxiliary motor 420 is provided parallel to the Z axis. The orbital drive mechanism 160 of FIG. 4 presents an overall crank shape. When the main motor 400 is driven in the configuration shown in FIG. 4, the polishing head mechanism 140 begins a circular motion. In the configuration of FIG. 4, the distance within the X-Y plane between the main motor 400 and the auxiliary motor 420 defines the radius of the circular motion. The auxiliary motor 420 rotates the polishing head mechanism 140 in a direction opposite to the direction of the circular motion of the polishing head mechanism 140 generated by the main motor 400 and in a period equal to that of the circular motion, and thereby rotation of the polishing head mechanism 140 around its own axis can be counteracted. The orbital driving of the polishing head mechanism 140 is realized by the cooperation of the main motor 400 and the auxiliary motor 420.

The X-direction linear actuator 180 and the Y-direction linear actuator 181 can be used as the orbital drive mechanism 160. For example, the orbital driving of the polishing head mechanism 140 can be realized by controlling the X-direction linear actuator 180 and the Y-direction linear actuator 181 so that the following conditional expressions are satisfied:

Conditional Expression Example: $X_{head}=R\cos(\omega t)$,
and, $Y_{head}=R\sin(\omega t)$ In the above expressions, $X_{head}$ is the X coordinate of a representative point of the polishing head mechanism 140 (for example, a center point of the polishing head main body 220), $Y_{head}$ is the Y coordinate of the representative point of the polishing head mechanism 140, R is the orbital drive radius, ω is the orbital drive angular frequency, and t is the elapsed time.

If the X-direction linear actuator 180 and the Y-direction linear actuator 181 are used as the orbital drive mechanism 160, the orbital driving of the polishing head mechanism 140 is realized by parallel movement within the X-Y plane. Therefore, if the X-direction linear actuator 180 and the Y-direction linear actuator 181 are used as the orbital drive mechanism 160, the polishing head mechanism 140 does not rotate around its own axis. Thus, in this case, it is not necessary to provide a mechanism (such as the auxiliary crank 213 or the auxiliary motor 420) for restricting the polishing head mechanism 140 from rotating around its own axis.

In addition to the examples described above, various embodiments of the orbital drive mechanism 160 can be utilized. For example, the orbital drive mechanism 160 may be configured by combining mechanisms such as motors, gears, and/or bearings.

Second Embodiment

In a second embodiment, a substrate polishing device 100 capable of locally controlling the pressing force between the substrate 130 and the polishing pad 150 in order to further improve the uniformity of polishing compared to the first embodiment will be explained.

Figure 5A:
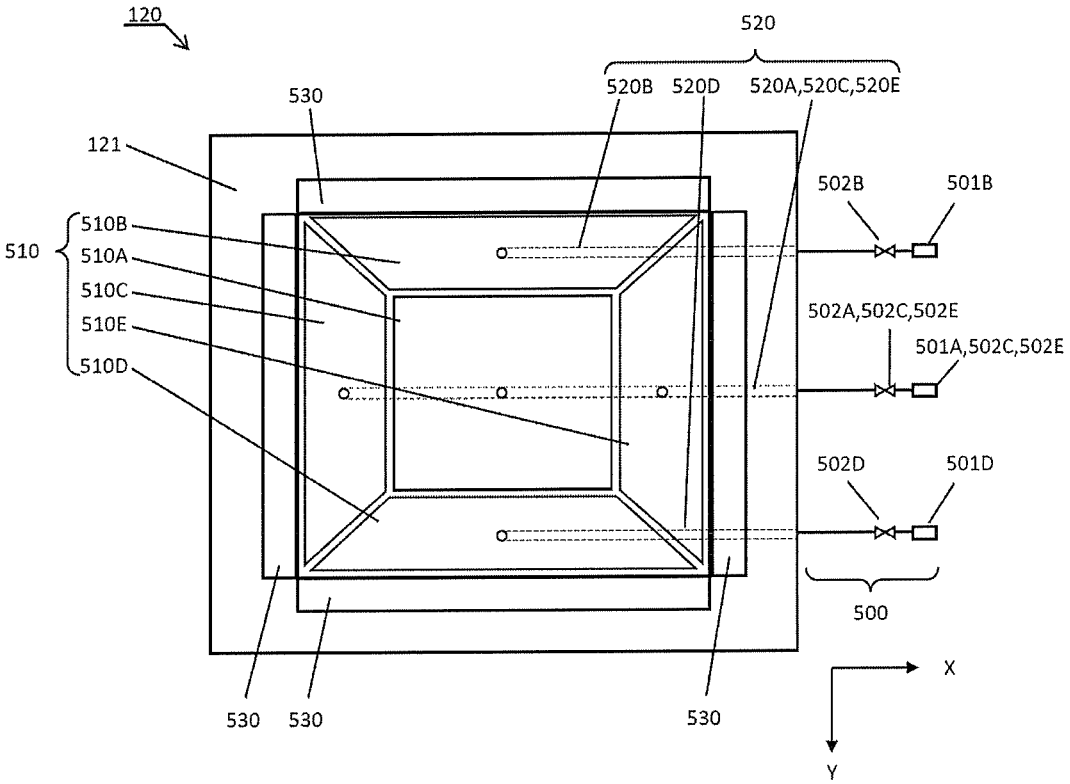
FIG. 5A is a top surface view of a substrate support mechanism.
Figure 5B:
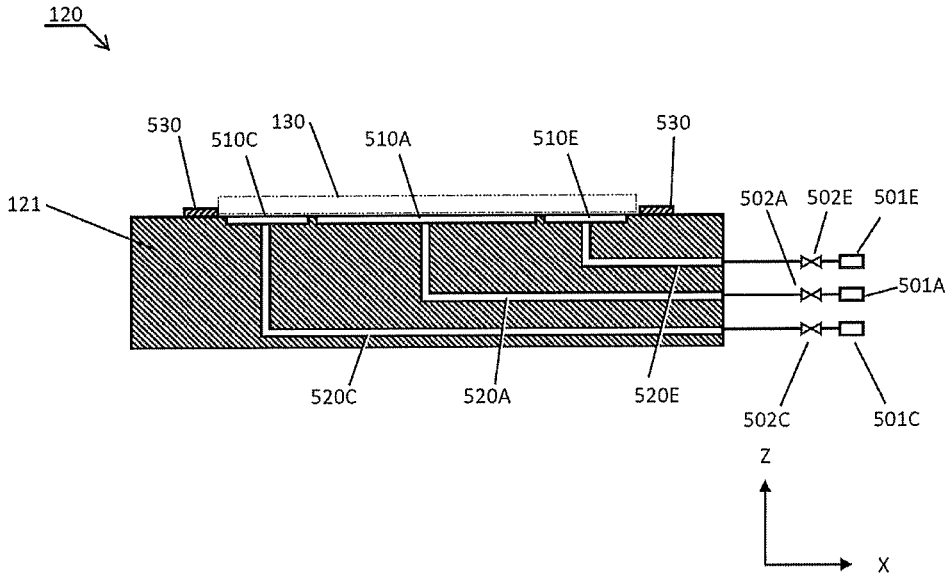
FIG. 5B is a front surface cross-section view of the substrate support mechanism.

FIG. 5 illustrates a substrate support mechanism 120 according to the present embodiment. FIG. 5A is a top surface view of the substrate support mechanism 120. FIG. 5B is a front surface cross-section view of the substrate support mechanism 120. Further, in FIG. 5B, the substrate 130 is illustrated with virtual lines (dot-dot-dash lines).

The substrate support mechanism 120 according to the present embodiment includes: a base plate 121; a plate flow passage(s) 520 provided to the base plate 121; and a plurality of substrate support chambers 510 that are connected to the plate flow passage 520. Further, a retainer(s) 530 for retaining the side surfaces of the substrate 130 is preferably provided on the base plate 121 so that the substrate 130 does not move in the X-Y plane. Herein, if the retainer 530 contacts the polishing pad 150, the retainer 530 may wear away. Therefore, the retainer 530 is preferably configured so that at least half of the thickness of the substrate 130 protrudes from the topmost part of the retainer 530. According to these preferable configurations, displacement of the substrate 130 during polishing can be prevented and wear of the retainer 530 can be prevented.

In the case that the retainer 530 is provided, the substrate 130 is supported by a portion of the base plate 121 that is surrounded by the retainer 530 (a region defined by the retainer 530). In other words, the size of the portion surrounded by the retainer 530 is approximately equal to the surface area of the substrate 130. Therefore, the size of the polishing head mechanism 140 (more specifically, the projected surface area of the portion of the polishing head mechanism 140 to which the polishing pad 150 is adhered) may be designed on the basis of the size of the portion surrounded by the retainer 530 (more specifically, the projected surface area of this portion). For example, configuring the polishing head mechanism 140 to be larger than the portion surrounded by the retainer 530 allows all points on the surface to be polished of the substrate 130 to be constantly in contact with the polishing pad 150 while the polishing head mechanism 140 is being orbitally driven. Further, for example, configuring the polishing head mechanism 140 to be smaller than the portion surrounded by the retainer 530 allows for the existence of points on the substrate 130 that are temporarily or constantly not in contact with the polishing pad 150 while the polishing head mechanism 140 is being orbitally driven.

The substrate support chambers 510 are provided so as to oppose the back surface of the substrate 130. The internal pressure of each substrate support chamber 510 is independent from the internal pressure of the other substrate support chambers 510. Each substrate support chamber 510 can independently apply a force in the vertical direction to the substrate 130. The vertical direction force applied to the substrate 130 corresponds to the internal pressure of the substrate support chamber 510. The substrate support chambers 510 are preferably configured so that the overall outer shape of the substrate support chambers 510 is similar to the shape of the substrate 130 and smaller than the substrate 130 when viewed from above. By configuring the outer shapes of the substrate 130 and the substrate support chambers 510 to be similar, the substrate support chambers 510 can be easily arranged along the corner parts and/or edge parts of the substrate 130. In the example of FIG. 5, the overall outer shape of the substrate support chambers 510 is a quadrilateral shape that is slightly smaller than the substrate 130 when viewed from above. Further, the substrate support chambers 510 are configured so that each substrate support chamber 510 can independently apply a vertical direction force to at least the corner parts and/or edge parts of the substrate 130 and to the portion other than the corner parts and/or edge parts of the substrate 130.

The edge parts of the substrate 130 can be, as one example, a region within 20 centimeters, within 10 centimeters, within 5 centimeters, within 1 centimeter, or within 0.5 centimeters from the edges of the substrate 130. As another example, the edge parts of the substrate 130 can be a region within ($\frac{1}{4}*L_{substrate}$), within ($\frac{1}{5}*L_{substrate}$), within ($\frac{1}{10}*L_{substrate}$), within ($\frac{1}{20}*L_{substrate}$), within ($\frac{1}{50}*L_{substrate}$), or within ($\frac{1}{100}*L_{substrate}$) from the edges of the substrate 130, wherein $L_{substrate}$ is the length of one side of the substrate 130. If the sides of the substrate 130 have different lengths, then $L_{substrate}$ may be the average value of the lengths of the sides. Further, as one example, the corner parts of the substrate 130 can be a region where one of the edge parts of the substrate 130 overlaps with another one of the edge parts of the substrate 130. As another example, the corner parts of the substrate 130 can be a region within a predetermined distance from the corners of the substrate 130. In addition, "the portion other than the corner parts and/or edge parts of the substrate 130" can also be referred to as the "center portion of the substrate 130".

The substrate support chambers 510 will be explained in detail below. In FIG. 5, a plurality of recesses are formed in the surface of the base plate 121 on which the substrate 130 is supported. Each recess is formed independently, and the recesses define the substrate support chambers 510. In the example of FIG. 5, a first substrate support chamber 510A, a second substrate support chamber 510B, a third substrate support chamber 510C, a fourth substrate support chamber 510D, and a fifth substrate support chamber 510E are formed. When the substrate 130 is supported on the base plate 121, the substrate 130 covers the opening portions of the respective substrate support chambers 510. A sealing member (not illustrated) such as an O-ring may be provided in the space between the respective substrate support chambers 510 and the substrate 130.

The first substrate support chamber 510A is provided to a portion of the base plate 121 (the center of the base plate 121 in the example of FIG. 5) corresponding to the center portion of the substrate 130. The first substrate support chamber 510A preferably has a shape that is similar to the substrate 130 and smaller than the substrate 130 when viewed from above. The first substrate support chamber 510A shown in FIG. 5 has a quadrilateral shape that is smaller than the substrate 130 when viewed from above.

The second substrate support chamber 510B to the fifth substrate support chamber 510E are each formed in a trapezoidal shape when viewed from above. In the example of FIG. 5, the second substrate support chamber 510B to the fifth substrate support chamber 510E are arranged so as to surround the first substrate support chamber 510A. In other words, the base side with the shorter length of each of the second substrate support chamber 510B to the fifth substrate support chamber 510E opposes the respective side of the first substrate support chamber 510A. The second substrate support chamber 510B to the fifth substrate support chamber 510E are provided to portions of the base plate 121 corresponding to the edge parts of the substrate 130, respectively.

Each substrate support chamber 510 communicates with one end of a plate flow passage 520 provided to the inside of the base plate 121 (in FIG. 5, a first plate flow passage 520A, a second plate flow passage 520B, a third plate flow passage 520C, a fourth plate flow passage 520D, and a fifth plate flow passage 520E). Each plate flow passage 520 communicates at the other end side with a pressure control mechanism 500.

The pressure control mechanism 500 controls the internal pressure of the substrate support chambers 510. In FIG. 5, pumps 501 and valves 502 constitute the pressure control mechanism 500. Specifically, in FIG. 5, a first pump 501A, a second pump 501B, a third pump 501C, a fourth pump 501D, and a fifth pump 501E are respectively connected to the first substrate support chamber 510A to the fifth substrate support chamber 510E. Valves 502 (a first valve 502A, a second valve 502B, a third valve 502C, a fourth valve 502D, and a fifth valve 502E) are provided between the respective pumps 501 and the respective substrate support chambers 510. The pressure control mechanism 500 of the example shown in FIG. 5 can set the internal pressures of the first substrate support chamber 510A to the fifth substrate support chamber 510E to different pressures. The pressure control mechanism 500 may be configured as a mechanism that increases or decreases the pressure of the substrate support chambers 510, or as a mechanism that both increases and decreases the pressure thereof. The pressure control mechanism 500 may be controlled by the control part 190.

In the configuration of FIG. 5, if the internal pressure of the first substrate support chamber 510A is set by the first pump 501A to be higher than atmospheric pressure, the center portion of the substrate 130 receives a force oriented vertically upward. If the internal pressure is increased, the vertically upward force received by the center portion of the substrate 130 becomes stronger. On the other hand, if the internal pressure of the first substrate support chamber 510A is set to be lower than atmospheric pressure, the center portion of the substrate 130 receives a force oriented vertically downward. If the internal pressure is decreased, the vertically downward force received by the center portion of the substrate 130 becomes stronger. Similarly, the edge parts of the substrate 130 receive a vertically upward force or a vertically downward force according to the internal pressures of the second substrate support chamber 510B to the fifth substrate support chamber 510E.

A portion of the substrate 130 that exists above a substrate support chamber 510 set to a higher pressure than the other substrate support chambers will be pressed more strongly to the polishing pad 150 than the other portions. In other words, according to the configuration of the present embodiment, the pressing force between the substrate 130 and the polishing pad 150 can be controlled locally. For example, if the polishing at the center portion of the substrate 130 is insufficient, the pressure of the first substrate support chamber 510A can be set higher than the pressures of the second substrate support chamber 510B to the fifth substrate support chamber 510E so as to eliminate the polishing insufficiency at the center portion of the substrate 130.

The configuration shown in FIG. 5 is merely one example. The number, size, and shape of the substrate support chambers 510 may be arbitrarily set. In FIG. 5, the substrate support chambers 510 are provided as a portion of the base plate 121. However, the base plate 121 and the substrate support chambers 510 may be separate independent parts. In FIG. 5, the plate flow passages 520 are provided only to the inside of the base plate 121. However, further flow passages may be provided to the inside of the surface plate 110. The plate flow passages 520 do not have to be completely independent. The plate flow passages 520 may be configured so that a plurality of auxiliary flow passages extend from a single main flow passage. As long as the pressure control mechanism 500 can control the pressure of the substrate support chambers 510, the configuration of the pressure control mechanism 500 is arbitrary. For example, regulators may be provided between the pumps 501 and the plate flow passages 520. As another example, one pump 501 may be connected to multiple plate flow passages 520.

Figure 6A:
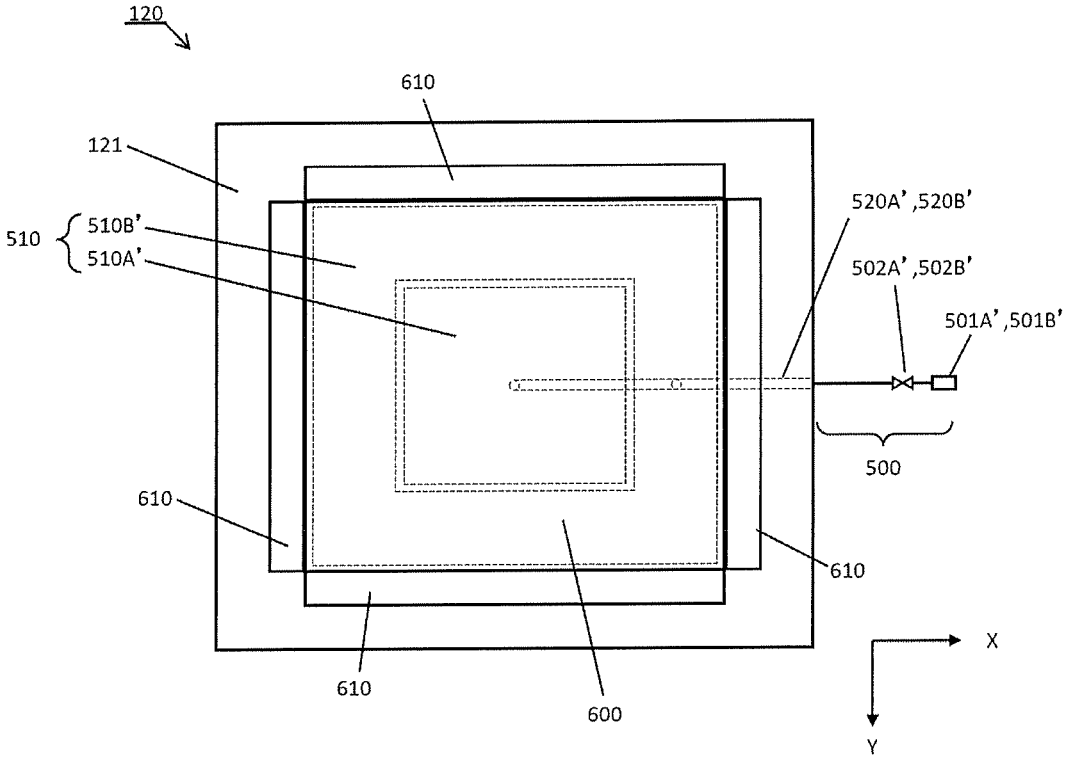
FIG. 6A is a top surface view of a substrate support mechanism provided with an elastic pad.
Figure 6B:
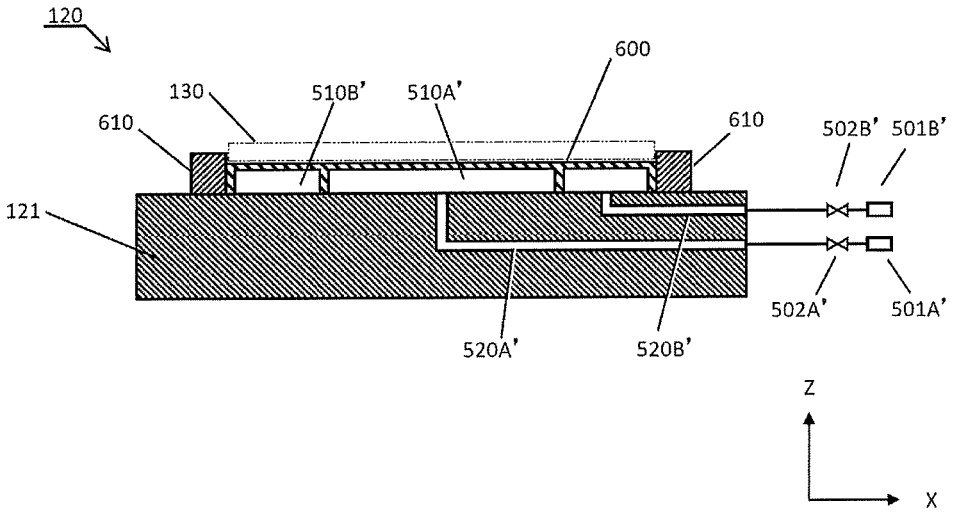
FIG. 6B is a front surface cross-section view of the substrate support mechanism provided with an elastic pad.

An alternative example of the substrate support chambers 510 will now be explained using FIG. 6. FIG. 6A is a top surface view of a substrate support mechanism 120 including an elastic pad 600. FIG. 6B is a front surface cross-section view of the substrate support mechanism 120 including the elastic pad 600. In FIG. 6B, the substrate 130 is illustrated with virtual lines (dot-dot-dash lines).

In the example of FIG. 5, the base plate 121 directly supports the substrate 130. On the other hand, in the example of FIG. 6, an elastic pad 600 is attached to the top of the base plate 121. The elastic pad 600 is stretchable at least in the vertical direction. The substrate 130 is supported by the top surface of the elastic pad 600. In the example of FIG. 6, a retainer(s) 610 for retaining the side surfaces of the substrate 130 is provided to the top of the base plate 121 so that the substrate 130 does not move in the X-Y plane. The retainer 610 is preferably configured so as to retain not only the substrate 130 but also the side surfaces of the elastic pad 600. The retainer 610 is preferably configured so that at least half of the thickness of the substrate protrudes from the topmost part of the retainer 610.

A plurality of spaces are provided to the inside of the elastic pad 600. These spaces define a plurality of substrate support chambers 510. In other words, the plurality of substrate support chambers 510 are formed by the elastic pad 600. In the example of FIG. 6, two substrate support chambers 510 (a first substrate support chamber 510A' and a second substrate support chamber 510B') are provided. The first substrate support chamber 510A' is provided at a position corresponding to the center portion of the substrate 130. The shape of the first substrate support chamber 510A' is a quadrilateral shape when viewed from above. The second substrate support chamber 510B' is provided on the periphery of the first substrate support chamber 510A'. The shape of the second substrate support chamber 510B' is a quadrilateral shape when viewed from above. Similar to the example of FIG. 5, each substrate support chamber 510 is connected to one end of a plate flow passage 520 (a first plate flow passage 520A' and a second plate flow passage 520B', respectively). The pressure control mechanism 500 is connected to the other ends of the plate flow passages 520. The pressure control mechanism 500 includes a first pump 501A', a second pump 501B', a first valve 502A', and a second valve 502B'.

The elastic pad 600 expands or contracts locally in the vertical direction according to the pressure of each of the substrate support chambers 510. Therefore, a portion of the substrate 130 that exists above a substrate support chamber 510 set to a higher pressure than the other substrate support chamber will be pressed more strongly to the polishing pad 150 than the other portions. As explained above, in the example of FIG. 6 as well, the pressing force between the substrate 130 and the polishing pad 150 can be controlled locally.

In the case that recesses formed in the base plate 121 are used as the substrate support chambers 510 as in FIG. 5, since the base plate 121 is a rigid body, it is conceivable that the flatness of the base plate 121 can be relatively high. In the example of FIG. 6, it is conceivable that fluid does not easily leak. The configuration in FIG. 5 and the configuration in FIG. 6 are preferably used selectively depending on the desired performance. The configuration in FIG. 5 and the configuration in FIG. 6 may also be used in combination.

Figure 7A:
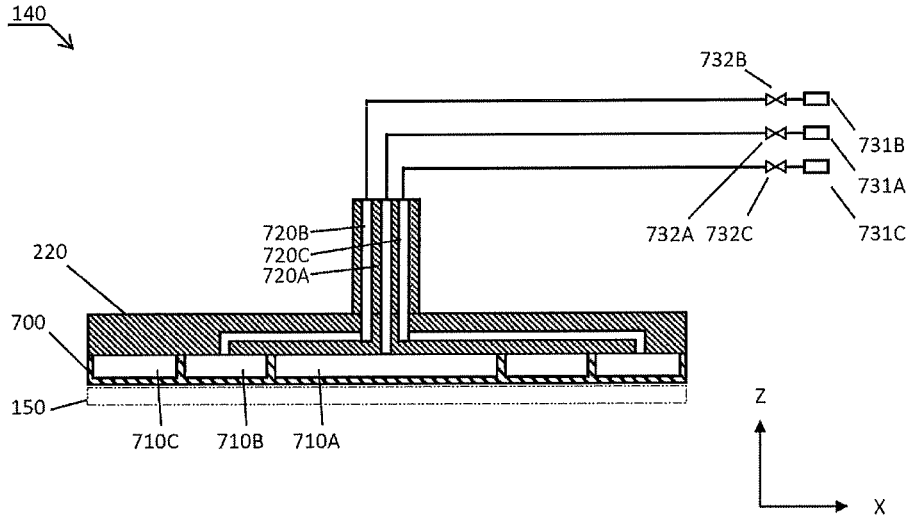
FIG. 7A is a front surface cross-section view of a polishing head mechanism provided with a polishing pad support chamber.
Figure 7B:
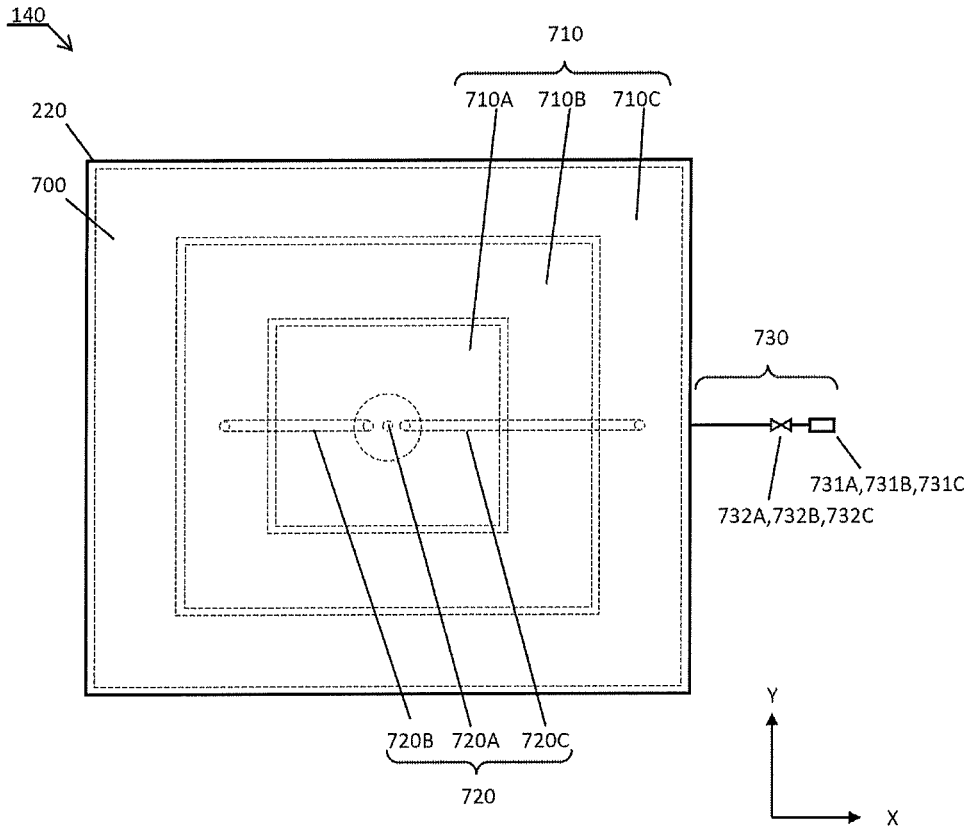
FIG. 7B is a bottom surface view of the polishing head mechanism provided with a polishing pad support chamber.

A chamber(s) may also be provided to the polishing head mechanism 140. FIG. 7 illustrates a polishing head mechanism 140 having polishing pad support chambers 710. FIG. 7A is a front surface cross-section view of the polishing head mechanism 140. FIG. 7B is a bottom surface view of the polishing head mechanism 140. In FIG. 7A, the polishing pad 150 is illustrated with virtual lines (dot-dot-dash lines). The polishing pad support chambers 710 are provided so as to oppose the back surface of the polishing pad 150.

An elastic pad 700 is provided to the bottom surface of polishing head main body 220. The polishing pad 150 is adhered to the elastic pad 700. The elastic pad 700 is stretchable at least in the vertical direction. A plurality of the polishing pad support chambers 710 are provided to the elastic pad 700. In the example of FIG. 7, three polishing pad support chambers 710 (a first polishing pad support chamber 710A, a second polishing pad support chamber 710B, and a third polishing pad support chamber 710C) are provided. The internal pressure of each polishing pad support chamber 710 is independent from the internal pressures of the other polishing pad support chambers 710. The first polishing pad support chamber 710A is positioned at the center portion of the polishing head main body 220. The second polishing pad support chamber 710B is positioned on the outside of the first polishing pad support chamber 710A. The third polishing pad support chamber 710C is positioned further to the outside of the second polishing pad support chamber 710B. The outer shape of the respective polishing pad support chambers 710 is a quadrilateral shape. Head flow passages 720 are provided to the inside of the polishing head main body 220. The respective polishing pad support chambers 710 are connected to one end of the head flow passages 720 (a first head flow passage 720A, a second head flow passage 720B, and a third head flow passage 720C). A pressure control mechanism 730 is connected to the other end of the head flow passages 720. The pressure control mechanism 730 in FIG. 7 controls the internal pressure of each polishing pad support chamber 710. The pressure control mechanism 730 includes pumps 731 (a first pump 731A, a second pump 731B, and a third pump 731C) and valves 732 (a first valve 732A, a second valve 732B, and a third valve 732C).

The elastic pad 700 expands or contracts locally in the vertical direction according to the pressure of each polishing pad support chamber 710. Therefore, a portion of the polishing pad 150 that exists above a polishing pad support chamber 710 set to a higher pressure than the other polishing head support chambers will be pressed more strongly to the substrate 130 than the other portions. Therefore, in the example of FIG. 7 as well, the pressing force between the substrate 130 and the polishing pad 150 can be controlled locally. By using the configuration of FIG. 7 alone, it is no longer necessary to provide chambers to the substrate support mechanism 120. However, it is also possible to control the pressing force by combining the configuration of FIG. 5 and/or FIG. 6 with the configuration of FIG. 7. If the configuration of FIG. 5 and/or FIG. 6 is combined with the configuration of FIG. 7, the controllable pressing force range can be expanded.

Several embodiments of the present invention have been explained above, but these embodiments of the invention are for the purpose of facilitating the understanding of the present invention, and are not intended to limit the present invention. The present invention may be modified or improved without departing from the gist of the invention, and the present invention obviously includes equivalents thereof. Further, the constituent elements described in the scope of the claims and the specification may be arbitrarily combined or eliminated within a scope in which the above-described problems can be at least partially solved or a scope in which the effects can be at least partially achieved.

REFERENCE SIGNS LIST

100 . . . substrate polishing device
110 . . . surface plate
120 . . . substrate support mechanism
121 . . . base plate
130 . . . substrate
140 . . . polishing head mechanism
150 . . . polishing pad
160 . . . orbital drive mechanism
170 . . . head vertical movement mechanism
180 . . . X-direction linear actuator
181 . . . Y-direction linear actuator
190 . . . control part
191 . . . storage part
200 . . . housing
201 . . . linear actuator
210 . . . motor box
211 . . . motor
212 . . . main crank
213 . . . auxiliary crank
214 . . . joint
220 . . . polishing head main body
221 . . . fluid supply line
222 . . . through hole
223 . . . through hole
400 . . . main motor
410 . . . arm
420 . . . auxiliary motor
500 . . . pressure control mechanism
501 . . . pump
502 . . . valve
510 . . . substrate support chamber
520 . . . plate flow passage
530 . . . retainer
600 . . . elastic pad
610 . . . retainer
700 . . . elastic pad
710 . . . polishing pad support chamber
720 . . . head flow passage
730 . . . pressure control mechanism
731 . . . pump
732 . . . valve

What is claimed is:

1. A substrate polishing device for polishing a quadrilateral-shaped substrate, the substrate polishing device comprising:

a surface plate;

a substrate support mechanism that is attached to the surface plate and that supports the substrate;

a polishing head mechanism for attaching a polishing pad, the polishing head mechanism opposing the surface plate; and an orbital drive mechanism for orbitally driving the polishing head mechanism, wherein the substrate support mechanism comprises:

a base plate;

a plate flow passage provided to the base plate; and a plurality of substrate support chambers provided so as to oppose the back surface of the substrate, wherein each substrate support chamber is connected to the plate flow passage, and an internal pressure of each substrate support chamber is independent from an internal pressure of the other substrate support chambers, the plurality of substrate support chambers comprises: a first chamber (510A) having a quadrilateral shape; a second chamber (510B) having a trapezoidal shape; a third chamber (510C) having a trapezoidal shape; a fourth chamber (510D) having a trapezoidal shape; and a fifth chamber (510E) having a trapezoidal shape;

the second to fifth chambers (510B, 510C, 510D, 510E) are arranged so as to surround the first chamber (510A), and an outermost perimeter of the plurality of substrate support chambers is a quadrilateral shape similar to the substrate.

2. The substrate polishing device according to claim 1, wherein each substrate support chamber applies to the substrate a vertical direction force corresponding to the internal pressure, the vertical direction force including a force pressing the substrate toward the polishing head mechanism.

3. The substrate polishing device according to claim 1, wherein at least one of the plurality of substrate support chambers is defined by a recess formed in the base plate.

4. The substrate polishing device according to claim 1, wherein at least one of the plurality of substrate support chambers is formed by an elastic pad attached to the base plate, the elastic pad attached to the base plate being stretchable at least in the vertical direction.

5. The substrate polishing device according to claim 1, wherein the polishing head mechanism comprises:

a polishing head main body;

a head flow passage provided to the polishing head main body; and a plurality of polishing pad support chambers provided so as to oppose the back surface of the polishing pad, wherein each polishing pad support chamber is connected to the head flow passage, and an internal pressure of each polishing pad support chamber is independent from an internal pressure of the other polishing pad support chambers.

6. The substrate polishing device according to claim 1, wherein the polishing head mechanism and the orbital drive mechanism are configured such that all points on a surface to be polished of the substrate are constantly in contact with the polishing pad while the polishing head mechanism is being orbitally driven.

7. The substrate polishing device according to claim 1, further comprising a pressure control mechanism that is connected to the plate flow passage.

8. A substrate polishing device for polishing a quadrilateral-shaped substrate, the substrate polishing device comprising:

a surface plate for directly or indirectly supporting the substrate;

a polishing head mechanism for attaching a polishing pad, the polishing head mechanism opposing the surface plate; and an orbital drive mechanism for orbitally driving the polishing head mechanism, wherein the polishing head mechanism comprises:

a polishing head main body;

a head flow passage provided to the polishing head main body; and a plurality of polishing pad support chambers provided so as to oppose the back surface of the polishing pad, wherein each polishing pad support chamber is connected to the head flow passage, and an internal pressure of each polishing pad support chamber is independent from an internal pressure of the other polishing pad support chambers, the plurality of polishing pad support chambers comprises: a first chamber (710A) positioned at a center portion of the polishing head main body, an outer shape of the first chamber (710A) being a quadrilateral shape; a second chamber (710B) positioned on the outside of the first chamber (710A), an outer shape of the second chamber (710B) being a quadrilateral shape; and a third chamber (710C) positioned on the outside of the second chamber (710B), an outer shape of the third chamber (710C) being a quadrilateral shape.

9. The substrate polishing device according to claim 8, wherein the plurality of polishing pad support chambers are formed by an elastic pad attached to the polishing head main body, the elastic pad attached to the polishing head main body being stretchable at least in the vertical direction.

* * * * *